US009044779B2

(12) United States Patent
Thompson et al.

(10) Patent No.: US 9,044,779 B2
(45) Date of Patent: Jun. 2, 2015

(54) METHOD FOR APPLYING A POWDER COATING

(75) Inventors: Steven Thomas Thompson, Jarrow (GB); Robert Edward Barker, Hebburn (GB); Neil Lewis Engward, Sunderland (GB); Gavin John Scott, Gateshead (GB)

(73) Assignee: AKZO NOBEL COATINGS INTERNATIONAL B.V., Arnhem (NL)

( * ) Notice: Subject to any disclaimer, the term of this patent is extended or adjusted under 35 U.S.C. 154(b) by 0 days.

(21) Appl. No.: 13/642,754

(22) PCT Filed: Apr. 27, 2011

(86) PCT No.: PCT/EP2011/056636

§ 371 (c)(1), (2), (4) Date: Oct. 22, 2012

(87) PCT Pub. No.: WO2011/134986

PCT Pub. Date: Nov. 3, 2011

(65) Prior Publication Data

US 2013/0040066 A1 Feb. 14, 2013

Related U.S. Application Data

(60) Provisional application No. 61/329,270, filed on Apr. 29, 2010.

(30) Foreign Application Priority Data

Apr. 29, 2010 (EP) ..... 10161469

(51) Int. Cl.

| | |
|---|---|
| ***B05D 1/06*** | (2006.01) |
| ***B05D 1/36*** | (2006.01) |
| ***B05B 5/053*** | (2006.01) |
| ***B05D 7/00*** | (2006.01) |
| *B05B 5/03* | (2006.01) |
| *B05B 5/043* | (2006.01) |

(52) U.S. Cl.

CPC . *B05D 1/06* (2013.01); *B05B 5/032* (2013.01); *B05B 5/043* (2013.01); *B05B 5/0535* (2013.01); *B05B 5/0536* (2013.01); *B05D 1/36* (2013.01); *B05D 7/542* (2013.01); *B05D 2451/00* (2013.01)

(58) Field of Classification Search

CPC ..... B05D 1/007; B05D 1/06; B05D 1/36; B05D 1/52

USPC ..... 427/470, 475

See application file for complete search history.

(56) References Cited

U.S. PATENT DOCUMENTS

| | | | | |
|---|---|---|---|---|
| 3,323,934 | A | 6/1967 | Point | |
| 3,904,346 | A * | 9/1975 | Shaw et al. | 427/481 |
| 3,998,716 | A * | 12/1976 | Masar et al. | 204/488 |
| 4,774,102 | A * | 9/1988 | Kiefer et al. | 427/475 |
| 6,032,871 | A * | 3/2000 | Borner et al. | 239/3 |
| 6,132,883 | A * | 10/2000 | McGrath et al. | 428/457 |
| 2004/0159282 | A1 | 8/2004 | Sanner et al. | |

FOREIGN PATENT DOCUMENTS

| | | |
|---|---|---|
| DE | 102 28 182 | 10/2003 |
| EP | 1 547 698 | 6/2005 |
| EP | 2 060 328 | 5/2009 |
| WO | 97/05965 | 2/1997 |
| WO | 2005/018832 | 3/2005 |
| WO | 2008/088650 | 7/2008 |

OTHER PUBLICATIONS

International Search Report and Written Opinion of the International Searching Authority for International Application No. PCT/EP2011/056636, mailed on Aug. 19, 2011.

* cited by examiner

*Primary Examiner* — Frederick Parker
(74) *Attorney, Agent, or Firm* — Kenyon & Kenyon LLP

(57) ABSTRACT

A method for the application of at least two different powder coating layers to a substrate comprising the steps of application of a first powder coating layer followed by the application of a second powder coating layer, without any substantial curing of the first powder coating layer prior to the application of the second powder coating layer, followed by the simultaneous curing of the first powder coating layer and the second powder coating layer, wherein the first powder coating layer is applied to the substrate using a corona charging system and the second powder coating layer is applied to the substrate using a tribo charging system, or the first powder coating layer is applied to the substrate using a tribo charging system and the second powder coating layer is applied to the substrate using a corona charging system and the first powder coating layer and second powder coating layer have an opposite electrostatic polarity.

20 Claims, No Drawings

METHOD FOR APPLYING A POWDER COATING

REFERENCE TO RELATED APPLICATIONS

This application is the U.S. National Phase of PCT/EP2011/056636 filed on Apr. 27, 2011, and claims the benefit of U.S. Provisional Application No. 61/329,270, filed on Apr. 29, 2010.

BACKGROUND OF THE INVENTION

1. Field of the Invention

Powder coatings are solid compositions which are generally applied by an electrostatic spray process in which the powder coating particles are electrostatically charged by the spray gun and the substrate is earthed. Alternative application methods include fluidised-bed and electrostatic fluidised-bed processes. After application, the powder is heated to melt and fuse the particles and to cure the coating.

The compositions generally comprise a solid film-forming resin, usually with one or more colouring agents such as pigments, and optionally they also contain one or more performance additives. They are usually thermosetting, incorporating, for example, a film-forming polymer and a corresponding crosslinking agent (which may itself be another film-forming polymer). Generally, the resins have a Tg, softening point or melting point above 30° C.

The compositions are generally prepared by mixing ingredients, e.g. in an extruder, at a temperature above the softening temperature of the resin but below the curing temperature. The composition is then cooled to solidify it and is subsequently pulverised. The particle size distribution required for most commercial electrostatic spray apparatus is up to a maximum of 120 microns, with a mean particle size within the range of 15 to 75 microns, preferably 25 to 50 microns, more especially 20 to 45 microns.

The present invention relates to a method for applying a powder coating to a substrate, more in particular to a process for applying at least two powder coating layers to a substrate without any substantial curing of the first layer prior to the application of the second or further layers. This process is sometimes referred to as a dry-on-dry application process.

2. Prior Art

In EP 08433598 a method is disclosed for simulating wood or marble in a finish by coating metal surfaces with a first layer of a colored powder coating layer, heating this layer to get a partial cure of this first layer (sometimes referred to as green cure), and thereafter applying a second colored powder coating layer, and subsequent heating of both layers to obtain a full cure of both layers.

In EP 1547698 a method is disclosed which is similar to the process in EP 08433598, albeit that in the process of EP 1547698 the heating step after the application of the first powder coating layer is absent.

In WO 2008/088650 a method is disclosed for painting a substrate wherein in a first step a powder primer is applied to the substrate, in a next step a powder basecoat comprising a flake additive is applied onto the primer, the powder primer and powder basecoat are simultaneously cured and thereafter a topcoat is applied onto the powder basecoat and in a last step this topcoat is cured.

In EP 2060328 a method for forming a composite powder coating is disclosed wherein multiple layers of a powder coating are deposited on a substrate, wherein adjacent layers are formed of different types of powder coating compositions and wherein the multiple layers of the powder coating composition are cured in a single thermal step.

In WO 2005/018832 a method for coating substrates is disclosed. Wherein an image coat is applied over a background coating. Both image coating and background coating can be powder coatings. It is not necessary to partially cure the background coating before the image coat is applied. In this process the polarity of the background/base coat and the image coat must be the same.

In US 2004/0159282 a respray or repair coating method using powder coatings is disclosed where the respray or repair coating may be performed before or after the cure of the initial layer. The initial coating layer and the repair/respray coating layer should have the same electrostatic polarity.

So far, there has been little commercial success for systems based on any of the above processes for the dry-on-dry application of at least two powder coating layers. Main reasons for this are surface defects in the top powder layer which, when cured lead to an unsatisfactory appearance with evidence of mixing of the two layers. These surface defects can be masked by using a matt or dull colored coating for the top powder layer. However, the surface defects are clearly visible when a high gloss topcoat is used.

SUMMARY OF THE INVENTION

Accordingly, in one embodiment the present invention comprises a method for the application of at least two different powder coating layers to a substrate comprising the steps of application of a first powder coating layer followed by the application of a second powder coating layer, without any substantial curing of the first powder coating layer prior to the application of the second powder coating layer, followed by the simultaneous curing of the first powder coating layer and the second powder coating layer, wherein the first powder coating layer is applied to the substrate using a corona charging system and the second powder coating layer is applied to the substrate using a tribo charging system, or the first powder coating layer is applied to the substrate using a tribo charging system and the second powder coating layer is applied to the substrate using a corona charging system, and the first powder coating layer and second powder coating layer have an opposite electrostatic polarity.

In another embodiment the invention relates to for the application of at least two different powder coating layers to a substrate comprising the steps of application of a first powder coating layer followed by the application of a second powder coating layer, without any substantial curing of the first powder coating layer prior to the application of the second powder coating layer, followed by the simultaneous curing of the first powder coating layer and the second powder coating layer, wherein a first powder coating layer is applied having a negative polarity using a corona charging system and the second powder coating layer is applied having a positive polarity using a tribo charging system, or a first powder coating layer is applied having a positive polarity using a tribo charging system and a second powder coating layer is applied having a negative polarity using a corona charging system.

Other embodiments of the invention comprise details concerning the application of the powder coating.

In this description wt. % refers to wt. % based on the total weight of a composition, unless specified otherwise.

DETAILED DESCRIPTION OF THE INVENTION

It was found that the process according to the present invention can be used to produce, in a reliable and consistent way, coated substrates without any surface defects and/or flaws in aesthetic appearance and with comparable performance characteristics to an equivalent two layered system prepared with an intermediate curing step. It was found that for this, the use of two different charging techniques to give an opposite polarity to the subsequent powder coating layers is an essential element.

Corona Charging System

In a corona charging system a high voltage generator is used to charge an electrode at the tip of the powder coating spray gun which creates an electrostatic field or ion cloud (corona) between the gun and the workpiece/substrate. The powder coating spray gun used in this type of process is called a Corona Gun. Compressed air is used to transport the powder through the gun, and also through the ion cloud. The powder particles pick up charge as they move through the cloud, and through a combination of pneumatic and electrostatic forces, travel towards and deposit upon the earthed target substrate. Most manufacturers of corona spray equipment utilize a negative corona voltage to impart a negative charge to the powder particles. It is possible, however, to use a positive corona voltage to apply a positive charge to a powder particle and such corona charging techniques fall within the scope of this invention.

Within the scope of the present invention, an ion capture device, e.g. a SuperCorona® system supplied by ITW Gema from Ransburg is considered as a negative corona charging system.

In one embodiment, the corona spray gun is charged between 30 and 100 kV when the powder coating is applied.

In a further, embodiment the corona spray gun is charged between 70 and 100 kV when the powder coating is applied.

In a further embodiment, the powder throughput using the corona application system is between 100 and 300 g/min.

In a further embodiment, the powder throughput using the corona application system is between 150 and 250 g/min.

Tribo Charging System.

In a tribo charging system use is made of the phenomenon that when two different insulating materials are rubbed together and then separated, they acquire opposite charges (+ and −). This method of generating charge via friction is one of the earliest phenomena associated with the electrical properties of materials. Instead of an electrode, tribo guns for the application of a powder coating rely on this friction charging to impart an electrostatic charge onto the powder particles. Compressed air is used to transport the powder particles through the gun. As they travel, the particles strike the walls of the gun, picking up a charge. The pneumatic force of the compressed air then carries the charged particles to the earthed substrate. It is known in the art that a positive charge can be applied to the powder particles by using a tribo gun made of a negative tribo material such as PTFE or similar material and that a negative charge can be applied to the particles by using a gun made of a positive tribo material such as nylon.

In one embodiment, the powder throughput using the tribo charging application system is between 50 and 300 g/min.

In another embodiment, the powder throughput using the tribo charging application system is between 150 and 250 g/min.

Coating Formulation

The function of coatings is to provide protection and/or an aesthetic appearance to a substrate. The film-forming resin and other ingredients are selected so as to provide the desired performance and appearance characteristics. In relation to performance, coatings should generally be durable and exhibit good weatherability, stain or dirt resistance, chemical or solvent resistance and/or corrosion resistance, as well as good mechanical properties, e.g. hardness, flexibility or resistance to mechanical impact; the precise characteristics required will depend on the intended use. The final composition must, of course, be capable of forming a coherent film on the substrate, and good flow and levelling of the final composition on the substrate are required. Accordingly, within a film-forming base, in addition to film-forming binder resin and optional crosslinker, pigment and/or filler there are generally one or more performance additives such as, for example, a flow-promoting agent, a wax, a plasticiser, a stabiliser, for example a stabiliser against UV degradation, or an anti-gassing agent, such as benzoin, an anti-settling agent, a surface-active agent, a UV-absorber, an optical whitener, a radical scavenger, a thickener, an anti-oxidant, a fungicide, a biocide, and/or an effect material, such as a material for gloss reduction, gloss enhancement, toughness, texture, sparkle and structure and the like. The following ranges should be mentioned for the total of the performance additive content of a film-forming polymeric material: 0% to 7% (preferably 0 to 5%) by weight, 0% to 3% by weight, and 1% to 2% by weight.

If performance additives are used, they are generally applied in a total amount of at most 5 wt. %, preferably at most 3 wt. %, more specifically at most 2 wt. %, calculated on the final composition. If they are applied, they are generally applied in an amount of at least 0.1 wt. %, more specifically at least 1 wt. %, calculated on the final composition As with pigments, these standard additives can be included during or after dispersing the binder components, but for optimum distribution it is preferred that they are mixed with the binder components before both are dispersed.

The film-forming polymer used in the manufacture of a film-forming component of a thermosetting powder coating material according to the invention may, for example, be one or more selected from carboxy-functional polyester resins, hydroxy-functional polyester resins, epoxy resins, functional acrylic resins and fluoropolymers.

Suitable thermally curable cross-linking systems for application as a coating composition are for example acid/epoxy, acid anhydride/epoxy, epoxy/amino resin, polyphenol/epoxy, phenol formaldehyde/epoxy, epoxy/amine, epoxy/amide, isocyanate/hydroxy, carboxy/hydroxyalkylamide, or hydroxylepoxy cross-linking systems. Suitable examples of these chemistries applied as powder coatings compositions are described in T. A. Misev, Powder Coatings Chemistry and Technology, John Wiley & Sons Ltd., 1991.

A film-forming component of the powder coating material can, for example, be based on a solid polymeric binder system comprising a carboxy-functional polyester film-forming resin used with a polyepoxide curing agent. Such carboxy-functional polyester systems are currently the most widely used powder coatings materials. The polyester generally has an acid value in the range 10-100, a number average molecular weight Mn of 1,500 to 10,000 and a glass transition temperature Tg of from 30° C. to 85° C., preferably at least 40° C. Examples of commercial carboxy-functional polyesters are: Uralac (Registered trademark) P3560 (DSM Resins) and Crylcoat (Registered trademark) 314 or (UCB Chemicals). The poly-epoxide can, for example, be a low molecular weight epoxy compound such as triglycidyl isocyanurate (TGIC), a compound such as diglycidyl terephthalate condensed glycidyl ether of bisphenol A or a light-stable epoxy resin. Examples of Bisphenol-A epoxy resins are Epikote (Registered trademark) 1055 (Shell) and Araldite (Registered trademark) GT 7004 (Ciba Chemicals). A carboxy-functional polyester film-forming resin can alternatively be used with a bis(beta-hydroxyalkylamide) curing agent such as tetrakis(2-hydroxyethyl)adipamide (Primid (Registered trademark) XL-552).

The electrostatic polarity of a powder coating can be determined in a qualitative way using a Faraday Pail. Use of a Faraday Pail enables the skilled person to distinguish between powder coatings having a positive electrostatic charge and powder coatings having a negative electrostatic charge.

It was found that in the process according to the present invention almost any type of powder coating can be used for the first powder coating layer and the second powder coating layer.

The film forming component in the first powder coating layer can be the same as in the second powder coating layer, but they can also be different.

The invention will be elucidated with reference to the following examples. These are intended to illustrate the invention but are not to be construed as limiting in any manner the scope thereof.

EXAMPLES

The following standard powder coatings were used in these examples

TABLE 1

| | Type | Color |
|---|---|---|
| PC1 | Epoxy primer | Dark grey |
| PC2 | 60:40 polyester/epoxy hybrid primer | Yellow |
| PC3 | Polyester/TGIC topcoat | Blue |
| PC4 | Polyester/primid topcoat | Green |
| PC5 | Polyurethane topcoat | White |

Various primer/topcoat combinations were applied to aluminium panels in a dry-on-dry process using a negative corona charging system and a positive tribo charging system. After the application thereof, the primer layer was not heated or cured, only after application of the topcoat was the whole coated substrate stoved at 180° C. for 15 minutes. The various combinations are listed in Table 2.

TABLE 2

| Example | First coating layer (primer) | | Second coating layer (topcoat) | |
|---|---|---|---|---|
| 1 | PC1 | C | PC3 | T |
| 2 | PC1 | C | PC4 | T |
| 3 | PC1 | C | PC5 | T |
| 4 | PC2 | C | PC3 | T |
| 5 | PC2 | C | PC4 | T |
| 6 | PC2 | C | PC5 | T |
| 7 | PC1 | T | PC3 | C |
| 8 | PC1 | T | PC4 | C |
| 9 | PC1 | T | PC5 | C |
| 10 | PC2 | T | PC3 | C |
| 11 | PC2 | T | PC4 | C |
| 12 | PC2 | T | PC5 | C |

C = application using a negative corona charging system
T = application using a positive tribo charging system

Comparative Example

To simulate the prior art, the process disclosed in EP 08433598 was performed using some of the standard powder coating compositions in Table 1. In a first step, the first powder coating layer was applied to an aluminium panel using a negative corona charging system and the panel was heated for 5. minutes at 180° C. Thereafter, the second powder coating layer was applied to the panel using a negative corona charging system and the panel was stoved at 180° C. for 15 minutes.

The various combinations are listed in Table 3

TABLE 3

| Example | First coating layer (primer) | | Second coating layer (topcoat) | |
|---|---|---|---|---|
| 13* | PC1 | C | PC3 | C |
| 14* | PC1 | C | PC4 | C |
| 15* | PC1 | C | PC5 | C |
| 16* | PC2 | C | PC3 | C |
| 17* | PC2 | C | PC4 | C |
| 18* | PC2 | C | PC5 | C |

*= comparative example
C = application using a negative corona charging system
T = application using a positive tribo charging system CIELAB measurements were taken for all samples using a dual beam spectrophotomer from Datacolour International with a 10° observer angle and 30 mm aperture. 60° gloss measurements were performed on all samples using a Sheen Instruments tri-gloss reflectometer. The results are presented in Table 4.

TABLE 4

| | CIELAB | | | |
|---|---|---|---|---|
| Example | L | a | b | Gloss |
| 1 | 46.6 | −15.3 | −30.9 | 60.0 |
| 7 | 46.7 | −15.3 | −30.9 | 63.3 |
| 13* | 46.6 | −15.4 | −31.0 | 63.7 |
| 2 | 31.9 | −13.2 | 3.9 | 35.7 |
| 8 | 32.0 | −13.1 | 3.8 | 37.0 |
| 14* | 31.7 | −12.7 | 3.7 | 38.0 |
| 3 | 97.4 | −1.0 | 0.8 | 93.0 |
| 9 | 97.1 | −1.0 | 0.5 | 93.0 |
| 15* | 97.3 | −1.0 | 0.6 | 92.0 |
| 4 | 46.6 | −15.3 | −31.0 | 61.0 |
| 10 | 46.7 | −15.4 | −31.0 | 64.0 |
| 16* | 46.7 | −15.3 | −31.0 | 63.3 |
| 5 | 31.9 | −13.2 | 3.9 | 34.3 |
| 11 | 32.0 | −13.3 | 3.9 | 37.3 |
| 17* | 31.8 | −12.8 | 3.7 | 38.3 |
| 6 | 97.8 | −0.8 | 1.1 | 93.0 |
| 12 | 97.6 | −0.8 | 1.0 | 93.0 |
| 18* | 97.3 | −0.9 | 0.7 | 93.0 |

*= comparative example

The above results show that the process according to the present invention can be used in a reliable way to produce multilayer powder coating systems, without the need of heating or curing between the application of the individual layers. The process can be used to produce systems with both high gloss and low gloss (or matt) systems, where the color is the same as the color of a system where the first layer of powder coating is heated/cured before the second layer is applied.

The invention claimed is:

1. A method for the application of at least two different powder coating layers to a substrate comprising the steps of application of a first powder coating layer followed by the application of a second powder coating layer, without any substantial curing of the first powder coating layer prior to the application of the second powder coating layer, followed by the simultaneous curing of the first powder coating layer and the second powder coating layer, wherein the first powder coating layer is applied to the substrate using a corona charging system and the second powder coating layer is applied to the substrate using a tribo charging system, or the first powder coating layer is applied to the substrate using a tribo charging system and the second powder coating layer is applied to the substrate using a corona charging system, and wherein the first powder coating layer and second powder coating layer have an opposite electrostatic polarity, and wherein the first powder coating layer comprises a polyester film-forming resin.

2. The method according to claim 1 wherein the first powder coating layer is applied having a negative polarity using the corona charging system and the second powder coating layer is applied having a positive polarity using the tribo charging system, or the first powder coating layer is applied having a positive polarity using the tribo charging system and the second powder coating layer is applied having a negative polarity using the corona charging system.

3. The method according to claim 1 wherein the corona charging system is charged to a potential of between 30 and 100 kV.

4. The method according to claim 3 wherein the corona charging system is charged to a potential of between 70 and 100 kV.

5. The method according to claim 1 wherein the first or the second powder coating layer is applied using the corona charging system at an application rate between 100 and 300 g/min.

6. The method according to claim 1 wherein the first or the second powder coating layer is applied using the tribo charging system at an application rate between 100 and 300 g/min.

7. The method according to claim 2 wherein the corona charging system is charged to a potential of between 30 and 100 kV.

8. The method according to claim 7 wherein the corona charging system is charged to a potential of between 70 and 100 kV.

9. The method according to claim 2 wherein the first or the second powder coating layer is applied using the corona charging system at an application rate between 100 and 300 g/min.

10. The method according to claim 3 wherein the first or the second powder coating layer is applied using the corona charging system at an application rate between 100 and 300 g/min.

11. The method according to claim 4 wherein the first or the second powder coating layer is applied using the corona charging system at an application rate between 100 and 300 g/min.

12. The method according to claim 7 wherein the first or the second powder coating layer is applied using the corona charging system at an application rate between 100 and 300 g/min.

13. The method according to claim 8 wherein the first or the second powder coating layer is applied using the corona charging system at an application rate between 100 and 300 g/min.

14. The method according to claim 2 wherein the first or the second powder coating layer is applied using the tribo charging system at an application rate between 100 and 300 g/min.

15. The method according to claim 3 wherein the first or the second powder coating layer is applied using the tribo charging system at an application rate between 100 and 300 g/min.

16. The method according to claim 4 wherein the first or the second powder coating layer is applied using the tribo charging system at an application rate between 100 and 300 g/min.

17. The method according to claim 5 wherein the first or the second powder coating layer is applied using the tribo charging system at an application rate between 100 and 300 g/min.

18. The method according to claim 7 wherein the first or the second powder coating layer is applied using the tribo charging system at an application rate between 100 and 300 g/min.

19. The method according to claim 8 wherein the first or the second powder coating layer is applied using the tribo charging system at an application rate between 100 and 300 g/min.

20. The method according to claim 10 wherein the first or the second powder coating layer is applied using the tribo charging system at an application rate between 100 and 300 g/min.

* * * * *